US008111227B2

(12) United States Patent
Lin et al.

(10) Patent No.: US 8,111,227 B2
(45) **Date of Patent: *Feb. 7, 2012**

(54) LIQUID CRYSTAL DISPLAY SYSTEM CAPABLE OF IMPROVING DISPLAY QUALITY AND METHOD FOR DRIVING THE SAME

(75) Inventors: Ching-Yao Lin, Chang-Hua Hsien (TW); Norio Oku, Taipei (TW)

(73) Assignee: Chimei Innolux Corporation, Chu-Nan Site, Hsinchu Science Park, Chu-Nan, Miao-Li County (TW)

( * ) Notice: Subject to any disclaimer, the term of this patent is extended or adjusted under 35 U.S.C. 154(b) by 1134 days.

This patent is subject to a terminal disclaimer.

(21) Appl. No.: 11/927,679

(22) Filed: Oct. 30, 2007

(65) Prior Publication Data

US 2008/0129906 A1 Jun. 5, 2008

(30) Foreign Application Priority Data

Dec. 1, 2006 (CN) ..... 2006 1 0160776

(51) Int. Cl.
*G09G 3/36* (2006.01)

(52) U.S. Cl. ..... 345/94; 345/87; 345/88; 345/98; 345/103

(58) Field of Classification Search ..... 345/87–104
See application file for complete search history.

(56) References Cited

U.S. PATENT DOCUMENTS

| | | | | |
|---|---|---|---|---|
| 5,576,730 | A * | 11/1996 | Shimada et al. | 345/98 |
| 5,798,742 | A * | 8/1998 | Watatani et al. | 345/98 |
| 6,252,566 | B1 * | 6/2001 | Maurice | 345/55 |
| 2004/0263507 | A1 * | 12/2004 | Sun | 345/212 |
| 2005/0024547 | A1 * | 2/2005 | Park | 349/39 |
| 2006/0274013 | A1 * | 12/2006 | Lin et al. | 345/98 |
| 2007/0030237 | A1 | 2/2007 | Chen | |
| 2007/0030238 | A1 | 2/2007 | Lin | |

FOREIGN PATENT DOCUMENTS

| | | | |
|---|---|---|---|
| EP | 0 883 102 | A1 | 12/1998 |
| FR | 2 507 803 | A1 | 12/1982 |
| JP | P2005208085 | A | 8/2005 |
| WO | 2004092812 | A1 | 10/2004 |
| WO | 2005109393 | A1 | 11/2005 |

* cited by examiner

*Primary Examiner* — Sumati Lefkowitz
*Assistant Examiner* — Robert E Carter, III
(74) *Attorney, Agent, or Firm* — Winston Hsu; Scott Margo

(57) ABSTRACT

Systems for displaying images incorporates a display device that includes a plurality of gate lines, a plurality of data lines intersecting the plurality of gate lines, a plurality of switches each having a first end coupled to a corresponding gate line and a second end coupled to a corresponding data line, a plurality of storage units each coupled to a third end of a corresponding switch for storing data received from a corresponding data line, a power line formed in parallel with the plurality of gate lines, and a plurality of coupling capacitors each having a first end coupled to the power line and a second end coupled to a corresponding data line.

17 Claims, 12 Drawing Sheets

LIQUID CRYSTAL DISPLAY SYSTEM CAPABLE OF IMPROVING DISPLAY QUALITY AND METHOD FOR DRIVING THE SAME

BACKGROUND OF THE INVENTION

1. Field of the Invention

The present invention relates to a liquid crystal display system and a method for driving the same, and more particularly, to a liquid crystal display system capable of improving display quality using a power line and a coupling capacitor and a method for driving the same.

2. Description of the Prior Art

Liquid crystal displays (LCDs) are flat displays characterized in thin appearance and low power consumption and have been widely used in various products, including personal digital assistants (PDAs), mobile phones, notebook/desktop computers, and communication terminals.

Reference is made to FIG. 1, which schematically depicts a prior art thin film transistor (TFT) LCD 10. The TFT LCD 10 includes a source driving circuit 12, a gate driving circuit 14, a plurality of data lines, gate lines $Gate_1$-$Gate_m$, demultiplexers $DUX_1$-$DUX_n$, and a plurality of pixel units. The data lines of the TFT LCD 10 includes red data lines $R_1$-$R_n$, green data lines $G_1$-$G_n$ and blue data lines $B_1$-$B_n$. The pixel units of the TFT LCD 10 includes red pixel units $P_{R1}$-$P_{Rn}$, green pixel units $P_{G1}$-$P_{Gn}$, and blue pixel units $P_{B1}$-$P_{Bn}$. The demultiplexers $DUX_1$-$DUX_n$ include control switches $SW_{R1}$, $SW_{G1}$, $SW_{B1}$ to $SW_{Rn}$, $SW_{Gn}$, $SW_{Bn}$, respectively. Each pixel unit, comprising a driving TFT switch and a capacitor, controls light according to charges stored in the capacitor. The gate driving circuit 14 generates scan signals for turning on/off the driving TFT switches of the pixel units via corresponding gate lines. The source driving circuit 12 generates data signals corresponding to images to be displayed by each pixel unit and sends the data signals to the pixels units via the control switches of corresponding demultiplexers. The TFT LCD 10 has a 1-to-3 demultiplexer structure, in which each demultiplexer distributes the data signals to three data lines. By respectively sending control signals $CKH_1$, $CKH_2$ and $CKH_3$ to the control switches $SW_{R1}$-$SW_{Rn}$, $SW_{G1}$-$SW_{GN}$, and $SW_{B1}$-$SW_{Bn}$, data signals can be written into the pixel units via corresponding demulitiplexers in a predetermined sequence.

Reference is made to FIG. 2, which is a timing diagram illustrating a prior art row-inversion method for driving the TFT LCD 10. In FIG. 2, $V_{GATE+}$ and $V_{GATE-}$ represent the gate signals sent to a gate line during the positive- and negative-polarity driving periods, respectively. $CKH_1$-$CKH_3$ represent the control signals sequentially applied to the control switches. $V_{COM}$ represents the common voltage of the TFT LCD 10. $V_{PIXEL+}(R)$, $V_{PIXEL+}(G)$ and $V_{PIXEL+}(B)$ respectively represent the voltage levels of the pixel units coupled to the red, green and blue data lines during the positive-polarity driving periods, which are respectively illustrated by dash lines, bold dash lines and dash-dot lines in FIG. 2. $V_{PIXEL-}(R)$, $V_{PIXEL-}(G)$ and $V_{PIXEL-}(B)$ respectively represent the voltage levels of the pixel units coupled to the red, green and blue data lines during the negative-polarity driving periods, which are respectively illustrated by dash lines, bold dash lines and dash-dot lines in FIG. 2 as well.

As can be seen in FIG. 2, data are written into the pixel units in an R-G-B sequence by sequentially applying the control signals $CKH_1$-$CKH_3$ for electrically connecting the source driving circuit 12 to corresponding red, green, or blue data lines. During the positive-polarity driving periods in the prior art row-inversion method, when the gate signal $V_{GATE+}$ applied to a gate line has a high voltage level, the TFT driving switches in the pixel units coupled to the gate line are turned on so that the capacitors in the pixel units coupled to the gate line can be electrically connected to corresponding data lines. Next, when the control signals $CKH_1$-$CKH_3$ have high voltage levels, the control switches respectively corresponding to the red, green and blue data lines in each demultiplexer are sequentially turned on. Therefore, the data signals generated by the source driving circuit 12 can be written into the pixel units coupled to the data lines via corresponding turned-on control switches, thereby changing the voltage levels of the red, green and blue pixel units accordingly.

Since inherent capacitance exists between the data lines, the voltage level of a data line is affected when the voltage level of an adjacent data line varies. Assuming the demultiplexer $DUX_2$ in FIG. 2 is used for illustration, $V_{GATE+}$ and $V_{GATE-}$ respectively represent the gate signals sent to the gate line $Gate_2$ during the positive and negative-polarity driving periods. $V_{PIXEL+}(R)$, $V_{PIXEL+}(G)$ and $V_{PIXEL+}(B)$ respectively represent the voltage levels of the pixel units $P_{R2}$, $P_{G2}$, $P_{B2}$ during the positive-polarity driving periods, while $V_{PIXEL-}(R)$, $V_{PIXEL-}(G)$ and $V_{PIXEL-}(B)$ respectively represent the voltage levels of the pixel units $P_{R2}$, $P_{G2}$, $P_{B2}$ during the negative-polarity driving periods.

During the positive-polarity driving periods when the data signal generated by the source driving circuit 12 is transmitted to the red data line $R_2$ via the demultiplexer $DUX_2$, the voltage $V_{PIXEL+}(R)$ goes high accordingly (at $T_1$ in FIG. 2). Also, coupling voltages $\Delta V_{GR}$ and $\Delta V_{BR}$ due to the inherent capacitance between the data lines are generated when the data signals are transmitted to the green data line $G_2$ and the blue data line $B_1$ both adjacent to the red data line $R_2$, causing the voltage $V_{PIXEL+}(R)$ to increase further (at $T_2$ and $T_3$ in FIG. 2). When the data signal generated by the source driving circuit 12 is transmitted to the green data line $G_2$ via the demultiplexer $DUX_2$, the voltage $V_{PIXEL+}(G)$ goes high accordingly (at $T_2$ in FIG. 2). Also, a coupling voltage $\Delta V_{BG}$ due to the inherent capacitance between the data lines is generated when the data signal is transmitted to the blue data line $B_2$ adjacent to the green data line $G_2$, causing the voltage $V_{PIXEL+}(G)$ to increase further (at $T_3$ in FIG. 2). When the data signal generated by the source driving circuit 12 is transmitted to the blue data line $B_2$ via the demultiplexer $DUX_2$, the voltage $V_{PIXEL+}(B)$ goes high accordingly (at $T_3$ in FIG. 2). When the TFT switches in the pixel units are turned off at $T_{first}$ in FIG. 2, liquid crystal voltages $V_{LC+}(R)$, $V_{LC+}(G)$, and $V_{LC+}(B)$ respectively represent the differences between the common voltage and the voltage levels of the red, green and blue pixel units during the positive-polarity driving periods. Similarly, when the TFT switches in the pixel units are turned off at $T_{second}$ in FIG. 2, liquid crystal voltages $V_{LC-}(R)$, $V_{LC-}(G)$, and $V_{LC-}(B)$ respectively represent the differences between the common voltage and the voltage levels of the red, green and blue pixel units during the negative-polarity driving periods.

Regardless of the positive- or negative-polarity driving periods, the illumination of a pixel unit is related to the absolute value of its liquid crystal voltage $V_{LC}$. In the positive-polarity driving periods after the TFT switches in the pixel units are turned off at $T_{first}$ in FIG. 2, the liquid crystal voltages corresponding to the red, blue and green pixel units have the following relationship: $V_{LC+}(R)>V_{LC+}(G)>$ and $V_{LC+}(B)$. Similarly, in the negative-polarity driving periods after the TFT switches in the pixel units are turned off at $T_{second}$ in FIG. 2, the liquid crystal voltages corresponding to the red, blue and green pixel units have the following relationship: $|V_{LC-}(R)|>|V_{LC-}(G)|>|V_{LC-}(B)|$. Therefore, when driving the TFT LCD 10 using the prior art driving method and displaying images of the same grayscale, the mismatches in the absolute values of the liquid crystal voltages and light transmittance will result in various degrees of color shifting, which largely affects the display quality of the TFT LCD 10.

SUMMARY OF THE INVENTION

Display systems and methods capable of improving display quality are provided. An embodiment of such a display system comprises an LCD device including a plurality of gate lines; a plurality of data lines intersecting the plurality of gate lines; a plurality of first switches each having a first end coupled to a corresponding gate line and a second end coupled to a corresponding data line; a plurality of storage units each coupled to a third end of a corresponding first switch for receiving data from the corresponding data line; a first power line formed in parallel with the plurality of gate lines; and a plurality of first coupling capacitors each having a first end coupled to the first power line and a second end coupled to the corresponding data line.

An embodiment of such a display method comprises turning on a first switch in a pixel unit coupled to a gate line for receiving a data signal from a corresponding data line; sequentially outputting data signals to a plurality of data lines via a demultiplexer; turning off the demultiplexer for keeping the plurality of data lines at a floating level; generating a coupling voltage by changing a voltage level of a power line from a first voltage level to a second voltage level, and transmitting the coupling voltage to a first data line of the demultiplexer via a coupling capacitor coupled between the power line and the first data line; and turning off the first switch in the pixel unit coupled to the gate line after generating the coupling voltage.

Another embodiment of such a display method comprises turning on a switch in a pixel unit coupled to a gate line for receiving a data signal from a corresponding data line; outputting data signals to a plurality of data lines using a source driving circuit; terminating outputting the data signals to the plurality of data lines for keeping the plurality of data lines at a floating level; generating a coupling voltage by changing a voltage level of a power line from a first voltage level to a second voltage level, and transmitting the coupling voltage to a first data line via a coupling capacitor coupled between the power line and the first data line after keeping the plurality of data lines at the floating level; and turning off the switch in the pixel unit coupled to the gate line after generating the coupling voltage.

DETAILED DESCRIPTION

Figure 1:
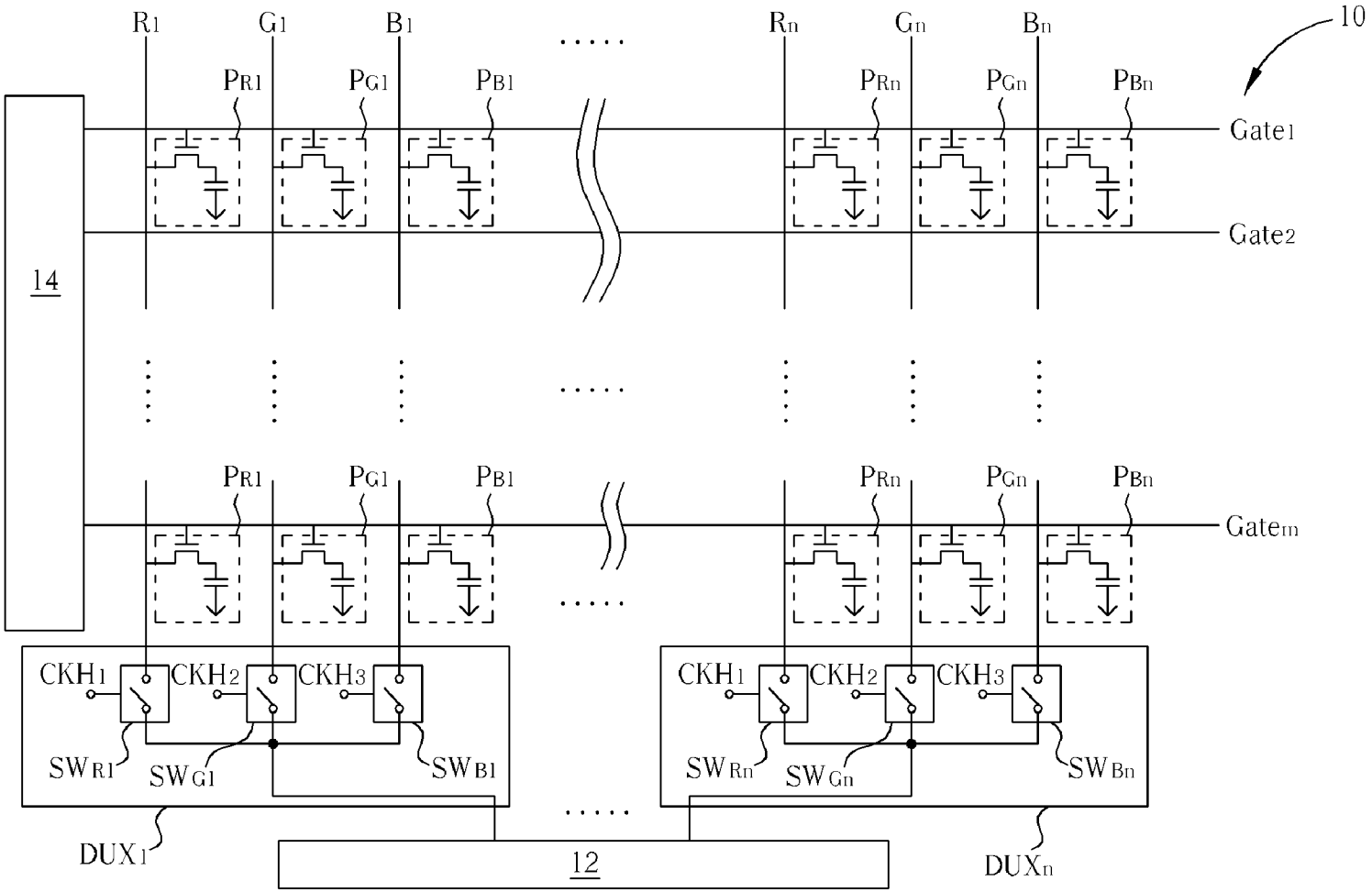
Fig. 1 Prior Art
FIG. 1 shows a prior art TFT LCD.
Figure 2:
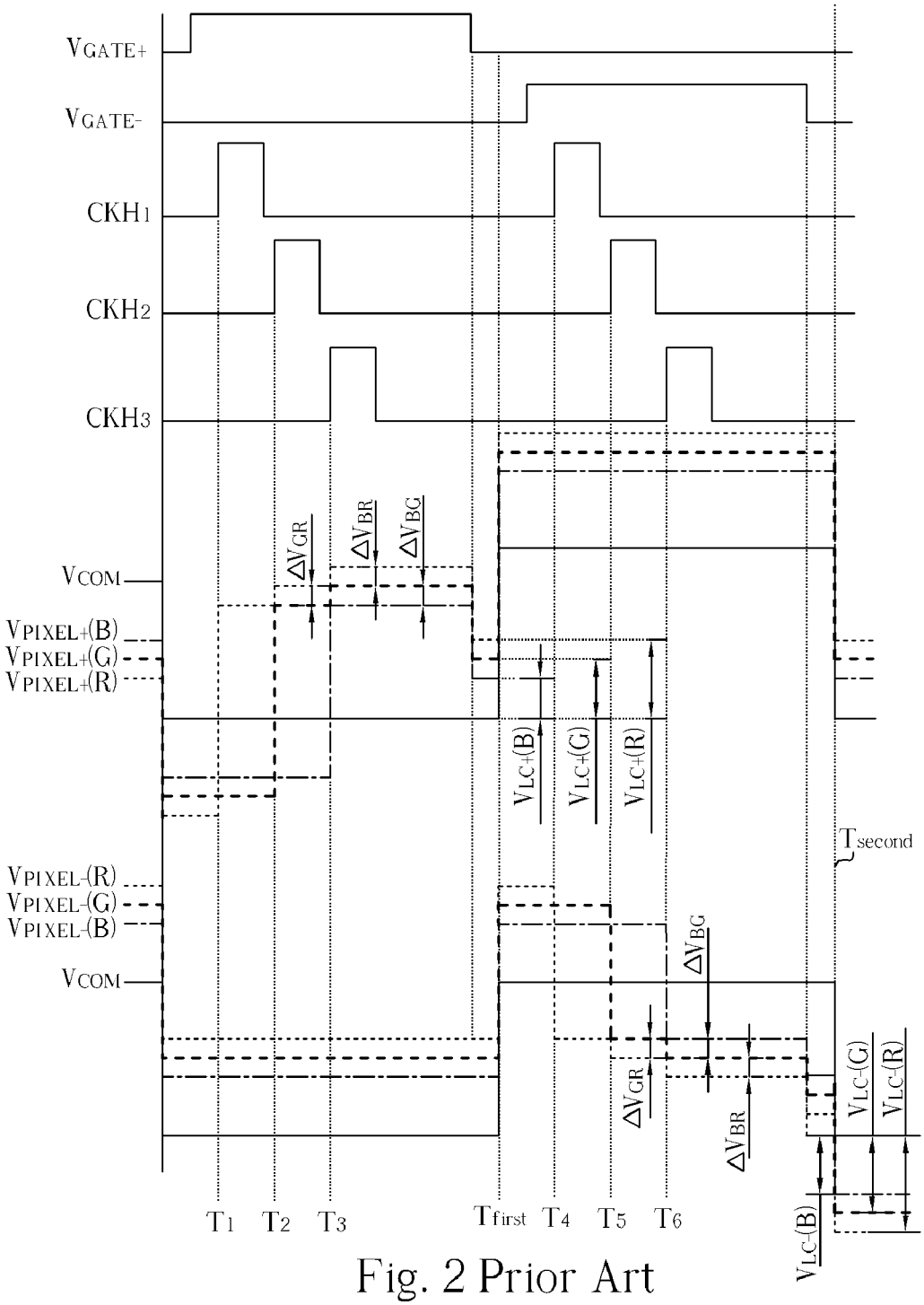
Fig. 2 Prior Art
FIG. 2 is a timing diagram illustrating a prior art row-inversion method for driving the TFT LCD of FIG. 1.
Figure 3:
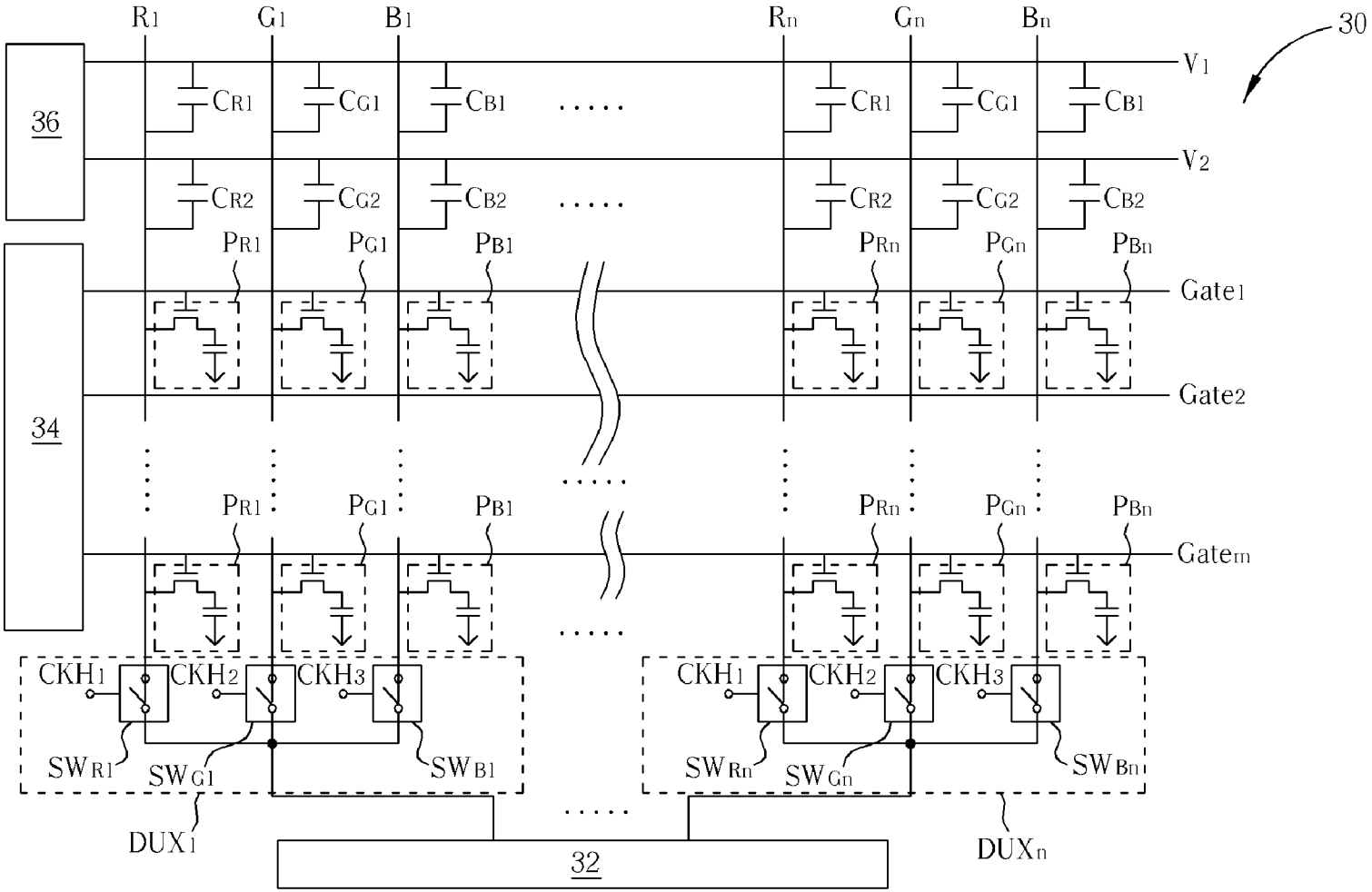
FIG. 3 shows a TFT LCD according to the present invention.

Reference is made to FIG. 3, which schematically depicts a TFT LCD 30 according to the present invention. The TFT LCD 30 includes a source driving circuit 32, a gate driving circuit 34, a control circuit 36, power lines $V_1$ and $V_2$, a plurality of coupling capacitors $C_{R1}$, $C_{G1}$, $C_{B1}$, $C_{R2}$, $C_{G2}$, and $C_{B2}$, a plurality of data lines, gate lines $Gate_1$-$Gate_m$, demultiplexers $DUX_1$-$DUX_n$, and a plurality of pixel units. The data lines of the TFT LCD 30 include red data lines $R_1$-$R_n$, green data lines $G_1$-$G_n$ and blue data lines $B_1$-$B_n$. The pixel units of the TFT LCD 30 include red pixel units $P_{R1}$-$P_{Rn}$, green pixel units $P_{G1}$-$P_{Gn}$, blue pixel units $P_{B1}$-$P_{Bn}$. The demultiplexers $DUX_1$-$DUX_n$ each include three control switches $SW_{R1}$, $SW_{G1}$, $SW_{B1}$ to $SW_{Rn}$, $SW_{Gn}$, $SW_{Bn}$, respectively. Each pixel unit, comprising a driving TFT switch and a capacitor, controls light according to charges stored in the capacitor. The gate driving circuit 34 generates scan signals for turning on/off the driving TFT switches in the pixel units via corresponding gate lines. The source driving circuit 32 generates data signals corresponding to images to be displayed by each pixel unit and sends the data signals to the pixels units via the control switches of corresponding demultiplexers. The coupling capacitors $C_{R1}$, $C_{G1}$ and $C_{B1}$ are coupled between the power line $V_1$ and corresponding red, green, blue data lines respectively. The coupling capacitors $C_{R2}$, $C_{G2}$ and $C_{B2}$ are coupled between the power line $V_2$ and corresponding red, green, blue data lines respectively. The voltage levels of the power lines $V_1$ and $V_2$ are controlled by the control circuit 36. The TFT LCD 30 has a 1-to-3 demultiplexer structure, in which each demultiplexer distributes the data signals to three data lines. By sending control signals $CKH_1$, $CKH_2$ and $CKH_3$ to the control switches $SW_{R1}$-$SW_{Rn}$, $SW_{G1}$-$SW_{Gn}$, and $SW_{B1}$-$SW_{Bn}$, the data signals can be written into the pixel units via corresponding demulitiplexers in a predetermined sequence.

Figure 4:
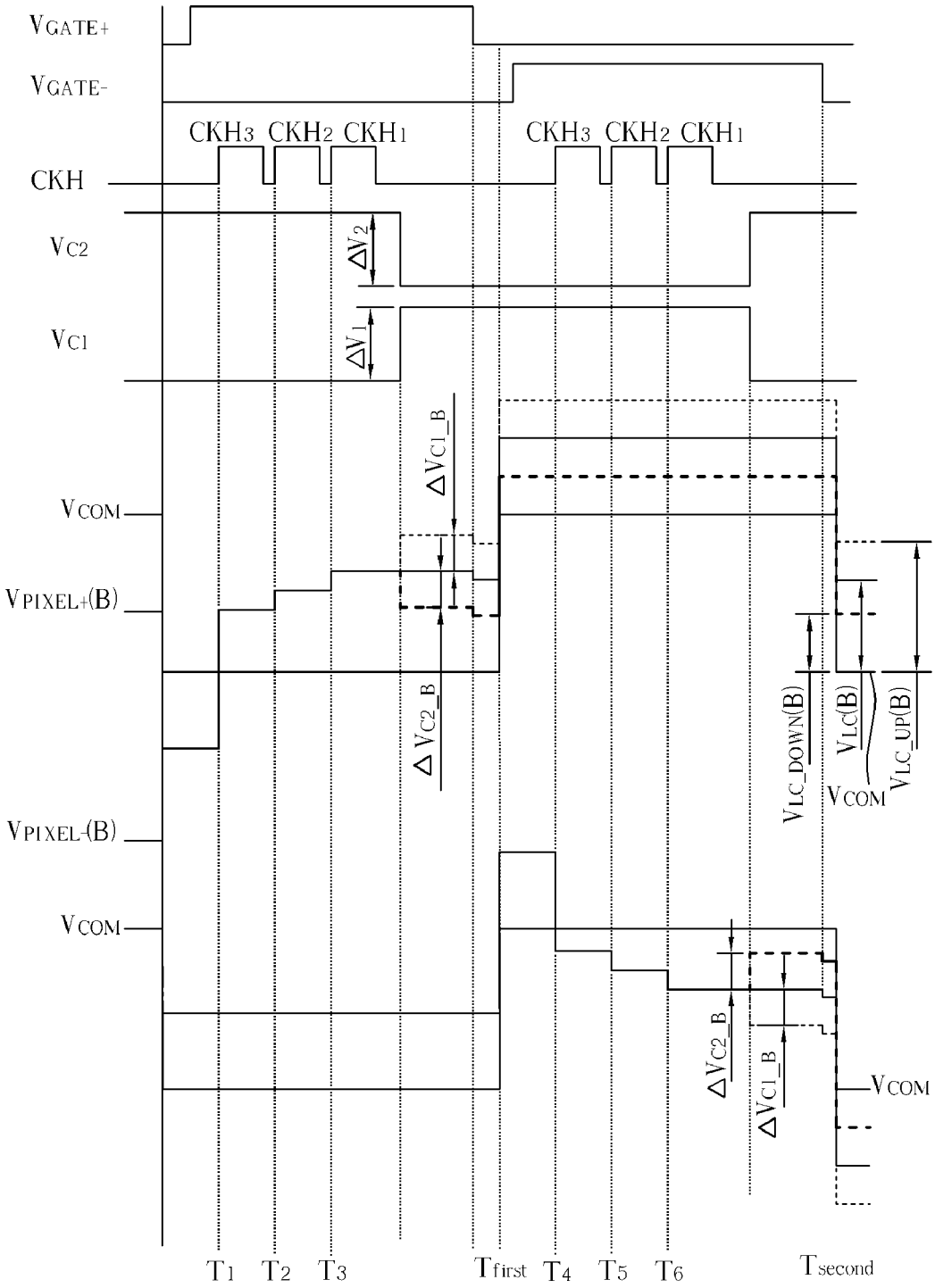
FIGS. 4-6 are timing diagrams illustrating a method for driving the TFT LCD in FIG. 3 according to a first embodiment of the present invention.
Figure 5:
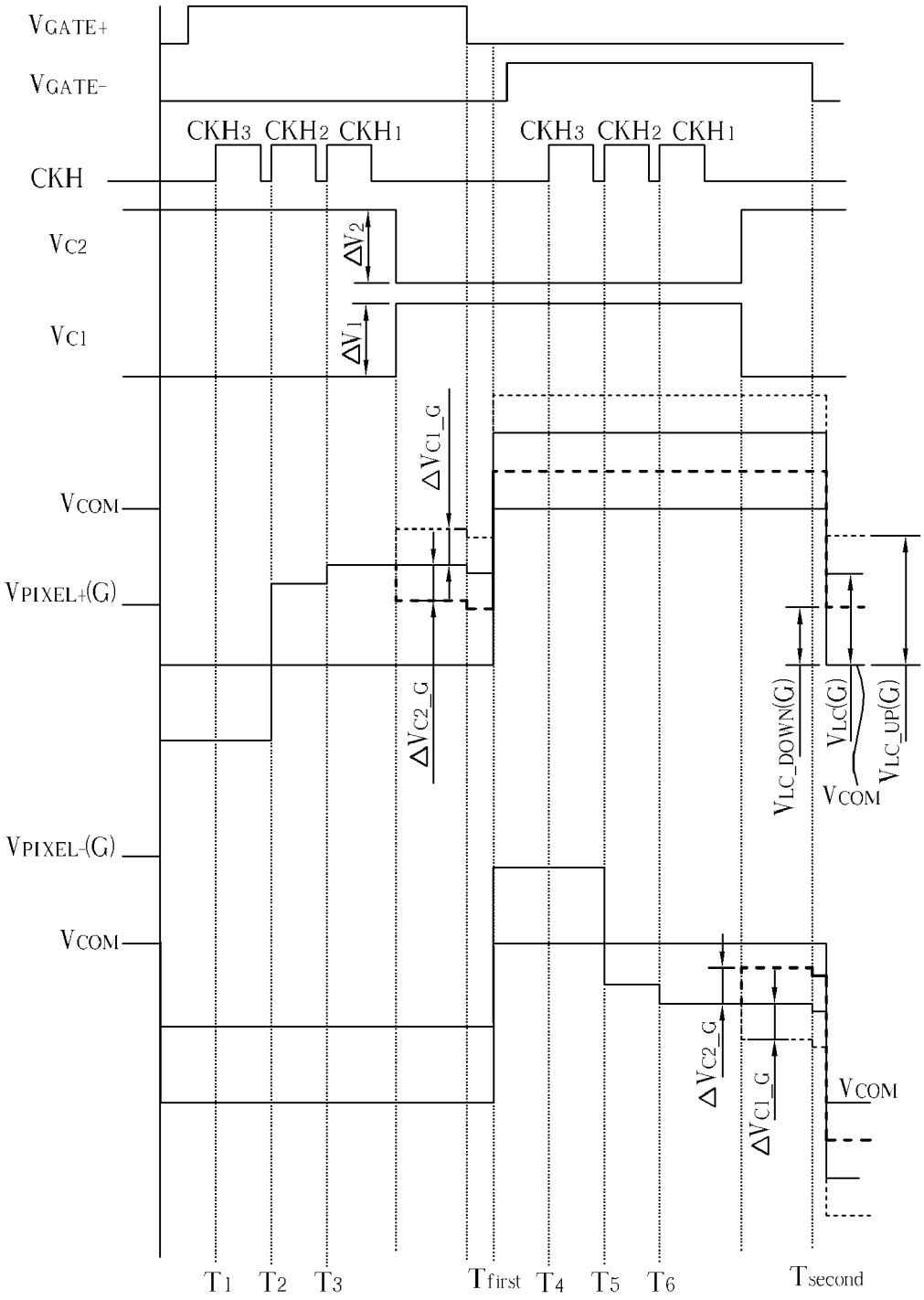
Figure 6:
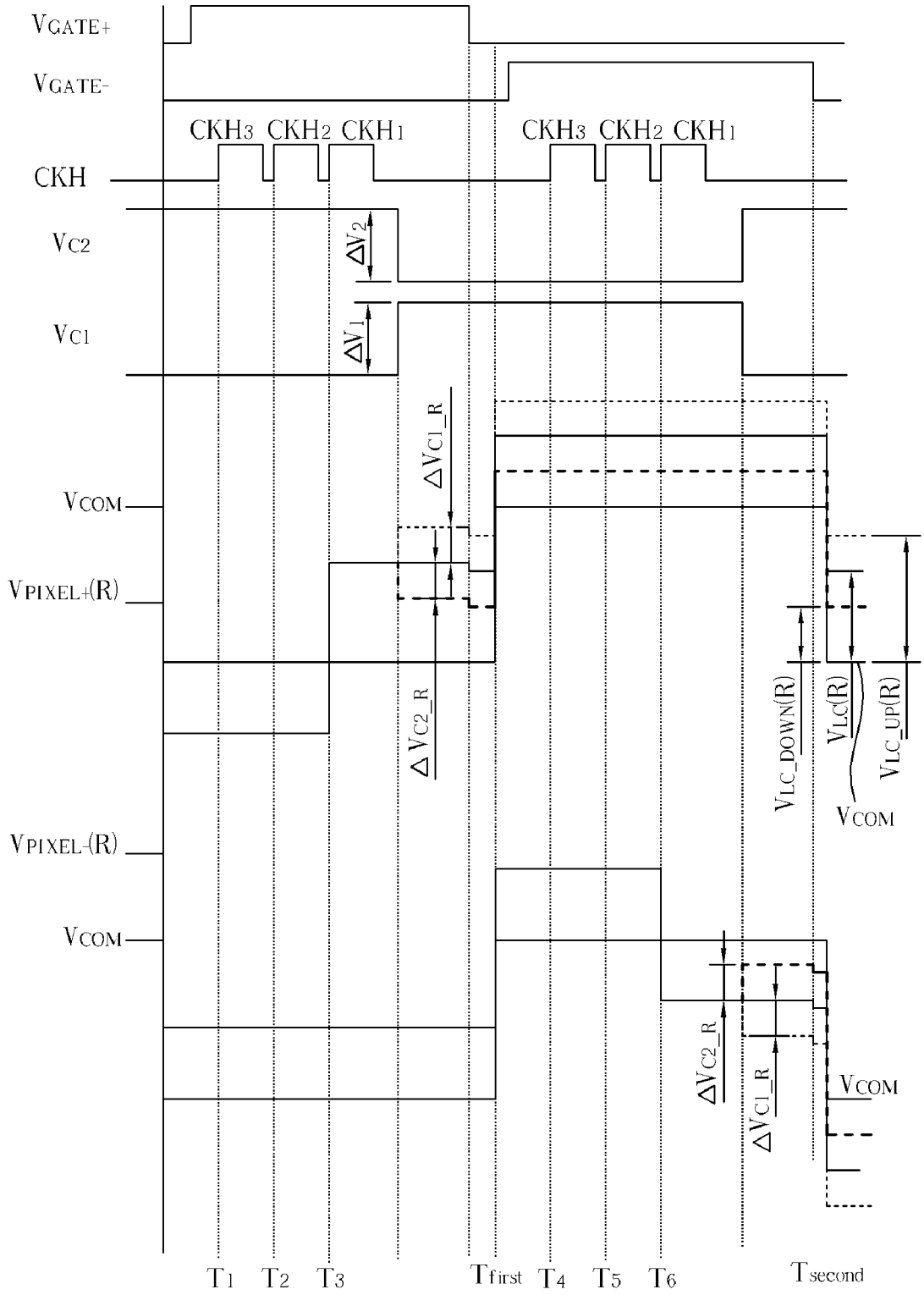

Reference is made to FIGS. 4-6, which are timing diagrams illustrating a method for driving the TFT LCD 30 according to a first embodiment of the present invention. In FIGS. 4-6, $V_{GATE+}$ and $V_{GATE-}$ represent the gate signals sent to a gate line during the positive- and negative-polarity driving periods, respectively. $CKH_3$-$CKH_1$ represent the control signals sequentially applied to the control switches. $V_{C1}$ and $V_{C2}$ represent the voltage levels of the power lines $V_1$ and $V_2$, respectively. $V_{COM}$ represents the common voltage of the TFT LCD 30. $V_{PIXEL+}(B)$, $V_{PIXEL+}(G)$ and $V_{PIXEL+}(R)$ respectively represent the voltage levels of the pixel units coupled to the blue, green and red data lines during the positive-polarity driving periods, which are respectively illustrated by dash lines, bold dash lines and dash-dot lines in FIGS. 4-6. $V_{PIXEL-}(B)$, $V_{PIXEL-}(G)$ and $V_{PIXEL-}(R)$ respectively represent the voltage levels of the pixel units coupled to the blue, green and red data lines during the negative-polarity driving periods, which are respectively illustrated by dash lines, bold dash lines and dash-dot lines in FIGS. 4-6 as well.

In the first embodiment of the present invention, data are written into the pixel units in a B-G-R sequence by sequentially applying the control signals $CKH_3$-$CKH_1$ for electrically connecting the source driving circuit 32 to the blue, green, and red data lines. During the positive-polarity driving periods when the gate signal $V_{GATE+}$ applied to a gate line has a high voltage level, the TFT driving switches in the pixel units coupled to the gate line are turned on so that the capacitors in the pixel units coupled to the gate line can be electrically connected to corresponding data lines.

Referring to FIG. 4, when the control signals $CKH_3$-$CKH_1$ are applied sequentially, the control switches corresponding to the blue, green and red data lines in each demultiplexer are sequentially turned on. Therefore, the data signals generated by the source driving circuit 32 can be written into corresponding pixel units via corresponding turned-on control switches in a B-G-R sequence. As mentioned before, since inherent capacitance exists between the data lines, the voltage level of a data line is affected when the voltage level of an adjacent data line varies.

Assuming the demultiplexer $DUX_2$ in FIG. 4 is used for illustration, $V_{GATE+}$ and $V_{GATE-}$ respectively represent the gate signals sent to the gate line $Gate_2$ during the positive- and negative-polarity driving periods. $V_{PIXEL+}(B)$ represents the voltage level of the pixel units $P_{B2}$ during the positive-polarity driving periods, while $V_{PIXEL-}(B)$ represents the voltage level of the pixel units $P_{B2}$ during the negative-polarity driving periods. During the positive-polarity driving periods, the voltage level $V_{PIXEL+}(B)$ of the pixel units $P_{B2}$ increases three times when the control signals $CKH_3$-$CKH_1$ have high voltage levels: the first voltage raise (at $T_1$ in FIG. 4) is due to the data signal transmitted from the source driving circuit 32 to the blue data line $B_2$ via the demultiplexer $DUX_2$; the second voltage raise (at $T_2$ in FIG. 4) is due to the coupling voltage caused by the inherent capacitance between the data lines when the data signal is transmitted from the source driving circuit 32 to the green data line $G_2$ adjacent to the blue data line $B_2$; the third voltage raise (at $T_3$ in FIG. 4) is due to the coupling voltage caused by the inherent capacitance between the data lines when the data signal is transmitted from the source driving circuit 32 to the red data line $R_3$ adjacent to the blue data line $B_2$. On the other hand, during the negative-polarity driving periods, the voltage level $V_{PIXEL-}(B)$ of the pixel units $P_{B2}$ drops three times when the control signals $CKH_3$-$CKH_1$ have high voltage levels: the first voltage drop (at $T_4$ in FIG. 4) is due to the data signal transmitted from the source driving circuit 32 to the blue data line $B_2$ via the demultiplexer $DUX_2$; the second voltage drop (at $T_5$ in FIG. 4) is due to the coupling voltage caused by the inherent capacitance between the data lines when the data signal is transmitted from the source driving circuit 32 to the green data line $G_2$ adjacent to the blue data line $B_2$; the third voltage drop (at $T_6$ in FIG. 4) is due to the coupling voltage caused by the inherent capacitance between the data lines when the data signal is transmitted from the source driving circuit 32 to the red data line $R_3$ adjacent to the blue data line $B_2$.

Similarly, FIG. 5 illustrates how the inherent capacitance influences the voltage level of the pixel units $P_{G2}$, and FIG. 6 illustrates how the inherent capacitance influences the voltage level of the pixel units $P_{R2}$.

In the embodiments illustrated in FIGS. 4-6, the voltage levels $V_{C1}$ and $V_{C2}$ of the power lines $V_1$ and $V_2$ each remain at a constant level when writing data into the data lines. For example, the voltages $V_{C1}$ and $V_{C2}$ are first kept at a high voltage level and a low voltage level, respectively. When the data lines become floated after writing the data signal into a last data line controlled by a demultiplexer and before a corresponding gate signal goes low, the voltage $V_{C1}$ and $V_{C2}$ can be altered in the first embodiment of the present invention. For example, the voltage $V_{C1}$ can be raised from a low level to a high level, while the voltage $V_{C2}$ can be lowered from a high level to a low level. As a result, voltage differences are generated across the corresponding coupling capacitors, thereby providing coupling voltages to corresponding pixel units for compensating different degrees of color shifting.

Referring to FIG. 4 again, if the user wants to increase the absolute values of the liquid crystal voltages $V_{LC+}(B)$ and $V_{LC-}(B)$ of the blue pixel units, the voltage $V_{PIXEL+}(B)$ obtained at $T_{first}$ in the positive-polarity driving periods has to be increased and the voltage $V_{PIXEL-}(B)$ obtained at $T_{second}$ in the negative-polarity driving periods has to be decreased. Under such circumstances, during the positive-polarity driving periods when the data lines become floated after writing the data signal into a last data line controlled by a demultiplexer and before a corresponding gate signal goes low, the voltage $V_{C1}$ of the power line $V_1$ is raised from a low level to a high level in the first embodiment of the present invention for providing a corresponding coupling capacitor with a voltage difference $\Delta V_1$, which in turn provides a corresponding blue data line with a coupling voltage $\Delta V_{C1_B}$. Therefore, the voltage $V_{PIXEL+}(B)$ obtained at $T_{first}$ and the absolute value of the liquid crystal voltages $V_{LC+}(B)$ of the blue pixel units can be increased at the same time. Similarly, during the negative-polarity driving periods when the data lines become floated after writing the data signal into a last data line controlled by a demultiplexer and before a corresponding gate signal goes low, the voltage $V_{C1}$ of the power line $V_1$ is lowered from a high level to a low level for providing a corresponding coupling capacitor with a voltage difference $\Delta V_1$, which in turn provides a corresponding blue data line with a coupling voltage $\Delta V_{C1_B}$. Therefore, the voltage $V_{PIXEL-}(B)$ obtained at $T_{second}$ can be decreased and the absolute value of the liquid crystal voltages $V_{LC-}(B)$ of the blue pixel units can be increased at the same time. In FIG. 4, the adjusted voltages $V_{PIXEL+}(B)$ and $V_{PIXEL-}(B)$ are illustrated by dashed lines.

If the user wants to decrease the absolute values of the liquid crystal voltages $V_{LC+}(B)$ and $V_{LC-}(B)$ of the blue pixel units, the voltage $V_{PIXEL+}(B)$ obtained at $T_{first}$ in the positive-polarity driving periods has to be decreased and the voltage $V_{PIXEL-}(B)$ obtained at $T_{second}$ in the negative-polarity driving periods has to be increased. Under such circumstances, during the positive-polarity driving periods when the data lines become floated after writing data into a last data line controlled by a demultiplexer and before a corresponding gate signal goes low, the voltage $V_{C2}$ of the power line $V_2$ is lowered from a high level to a low level for providing a corresponding coupling capacitor with a voltage difference $\Delta V_2$, which in turn provides a corresponding blue data line with a coupling voltage $\Delta V_{C2_B}$. Therefore, the voltage $V_{PIXEL+}(B)$ obtained at $T_{first}$ and the absolute value of the liquid crystal voltages $V_{LC+}(B)$ of the blue pixel units can be decreased at the same time. Similarly, during the negative-polarity driving periods when the data lines become floated after writing data into a last data line controlled by a demultiplexer and before a corresponding gate signal goes low, the voltage $V_{C2}$ of the power line $V_2$ is raised from a low level to a high level for providing a corresponding coupling capacitor with a voltage difference $\Delta V_2$, which in turn provides a corresponding blue data line with a coupling voltage $\Delta V_{C2_B}$. Therefore, the voltage $V_{PIXEL-}(B)$ obtained at $T_{second}$ can be increased and the absolute value of the liquid crystal voltages $V_{LC-}(B)$ of the blue pixel units can be decreased at the same time. In FIG. 4, the adjusted voltages $V_{PIXEL+}(B)$ and $V_{PIXEL-}(B)$ are illustrated by bold dashed lines.

In FIG. 4, the dashed lines represent the voltages $V_{PIXEL+}(B)$ and $V_{PIXEL-}(B)$ after being adjusted using the power line $V_1$ and the corresponding coupling capacitors, and the bold dashed lines represent the voltages $V_{PIXEL+}(B)$ and $V_{PIXEL-}(B)$ after being adjusted using the power line $V_2$ and the corresponding coupling capacitors. The values of the coupling voltages $\Delta V_{C1_B}$ and $\Delta V_{C_B}$ are related to the capacitances of the corresponding coupling capacitors and the voltage differences $\Delta V_1$ and $\Delta V_2$. Therefore in the first embodiment of the present invention, the absolute values of the liquid crystal voltages $V_{LC+}(B)$ and $V_{LC-}(B)$ of the blue pixel units can be adjusted flexibly by applying different voltage differences $\Delta V_1$ and $\Delta V_2$ to the power lines $V_1$ and $V_2$, or by using coupling capacitors having different capacitances. For example, in the positive-polarity driving periods illustrated in FIG. 4, the absolute value of the adjusted liquid crystal voltages $V_{LC_UP}(B)$ can be larger than that of the original liquid crystal voltages $V_{LC+}(B)$. Or, the absolute value of the adjusted liquid crystal voltages $V_{LC_DOWN}(B)$ can be smaller than that of the original liquid crystal voltages $V_{LC+}(B)$. As a result, the present invention can compensate color shifting of the blue pixel units flexibly.

Similarly, references are made to FIGS. 5 an 6 again. In FIG. 5, the dashed lines represent the voltages $V_{PIXEL+}(G)$ and $V_{PIXEL-}(G)$ when the user wants to increase the liquid crystal voltages of the green pixel units, and the bold dashed lines represent the voltages $V_{PIXEL+}(G)$ and $V_{PIXEL-}(G)$ when the user wants to decrease the liquid crystal voltages of the green pixel units. In FIG. 6, the dashed lines represent the voltages $V_{PIXEL+}(R)$ and $V_{PIXEL-}(R)$ when the user wants to increase the liquid crystal voltages of the red pixel units, and the bold dashed lines represent the voltages $V_{PIXEL+}(R)$ and $V_{PIXEL-}(R)$ when the user wants to decrease the liquid crystal voltages of the red pixel units.

Figure 8:
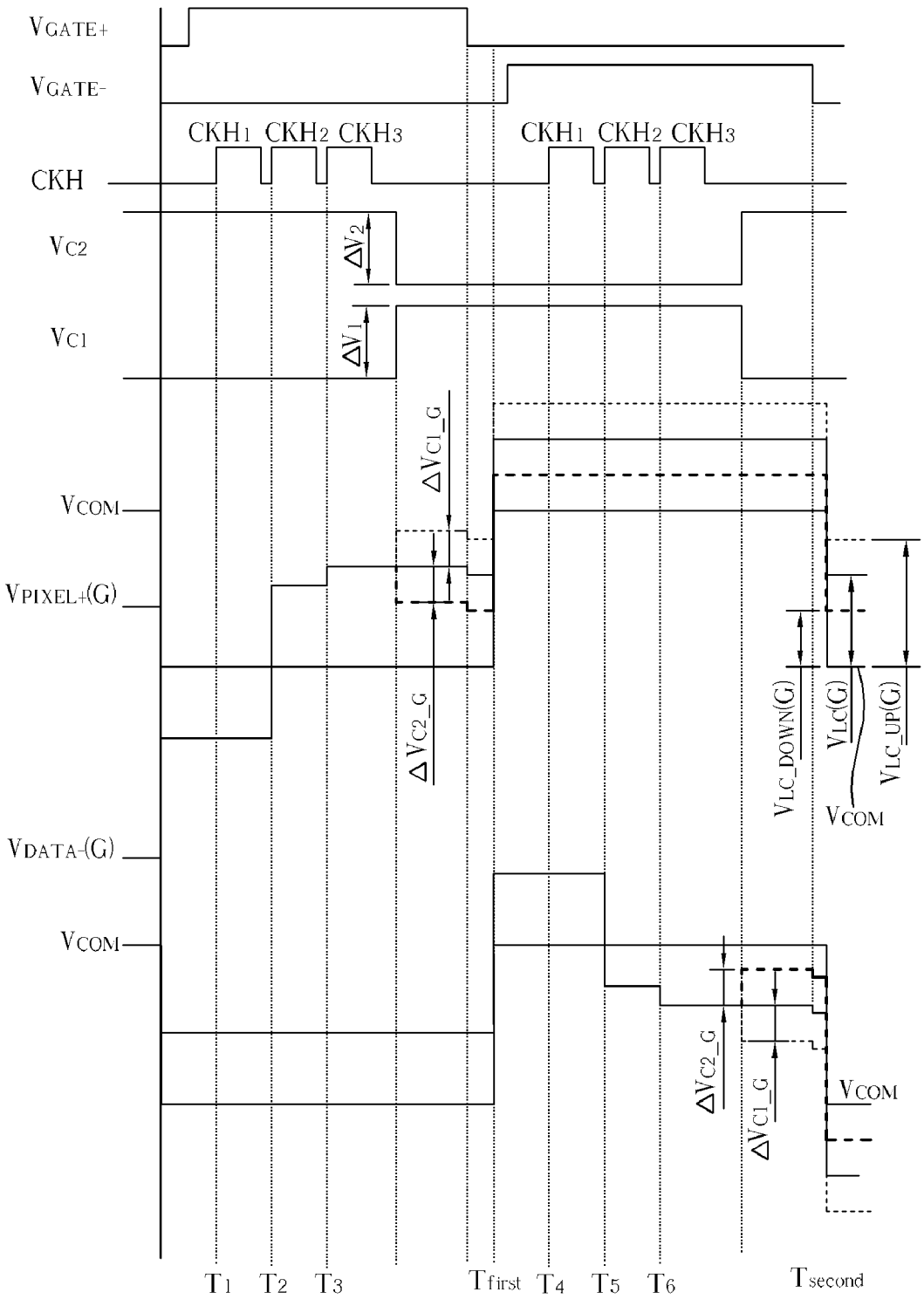
Figure 9:
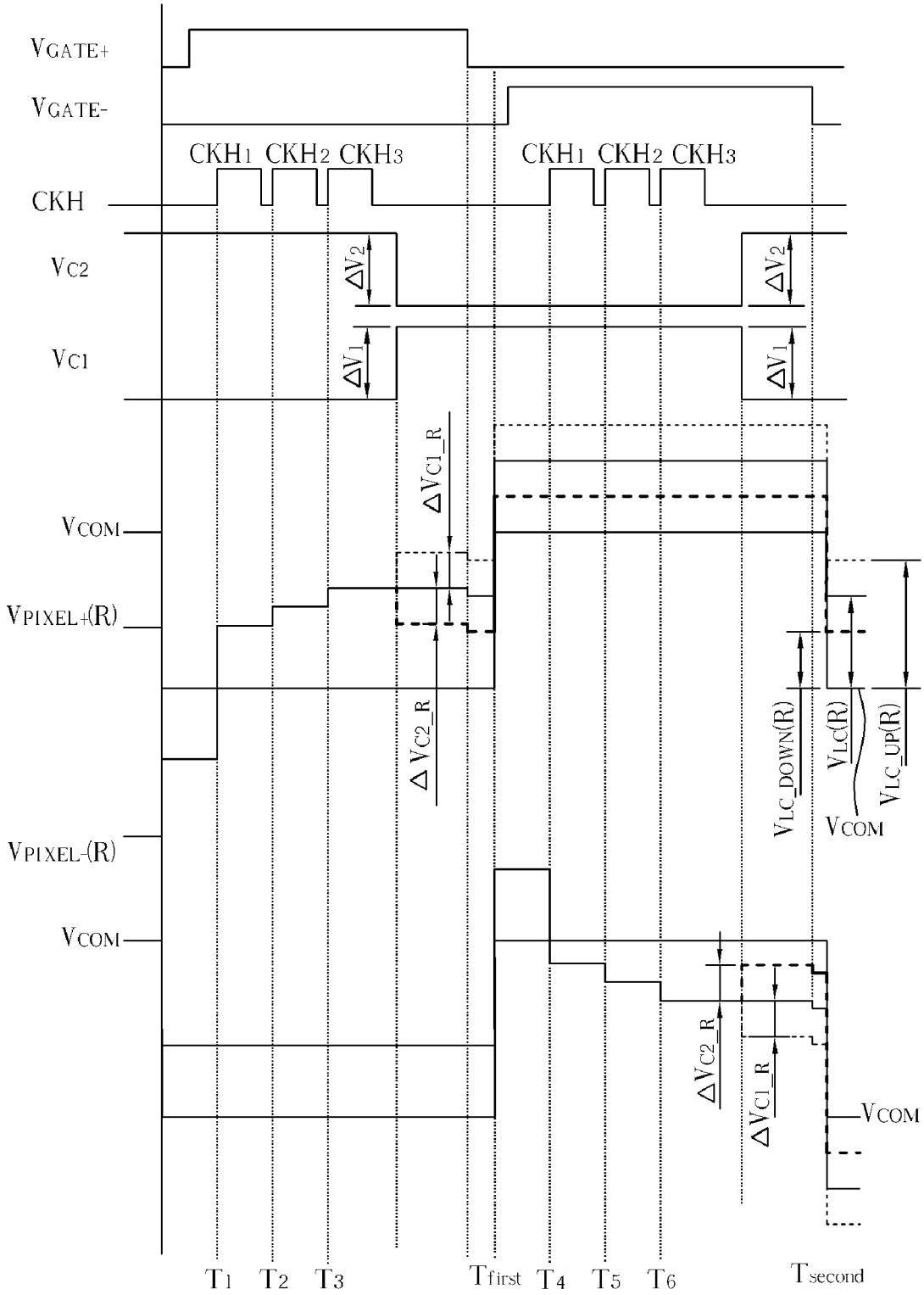

In the first embodiment of the present invention illustrated in FIGS. 4-6, data are written into the pixel units in a B-G-R sequence. However, the present invention can also be applied regardless of driving sequences. References are made to FIGS. 7-9, which are timing diagrams illustrating a method for driving the TFT LCD 30 according to a second embodiment of the present invention. In the second embodiment of the present invention, data are written into the pixel units in an R-G-B sequence by sequentially applying the control signals $CKH_1$-$CKH_3$ for electrically connecting the source driving circuit 32 to the corresponding red, green and blue data lines sequentially.

Similar to the first embodiment, the voltages $V_{C1}$ and $V_{C2}$ of the power lines $V_1$ and $V_2$ each remain at a constant level when writing the data signals into the data lines in the second embodiment of the present invention. The voltages $V_{C1}$ and $V_{C2}$ of the power lines $V_1$ and $V_2$ can be altered after writing data into a last data line controlled by a demultiplexer and before a corresponding gate signal goes low. Therefore, voltage differences across the corresponding coupling capacitors can be generated, thereby providing coupling voltages to corresponding pixel units for compensating different degrees of color shifting. Similarly, the values of the coupling voltages are related to the capacitances of the corresponding coupling capacitors and the voltage differences $\Delta V_1$ and $\Delta V_2$. Therefore in the second embodiment of the present invention, the absolute values of the liquid crystal voltages can be adjusted flexibly by applying different voltage differences $\Delta V_1$ and $\Delta V_2$ to the power lines $V_1$ and $V_2$, or by using coupling capacitors having different capacitances.

Figure 7:
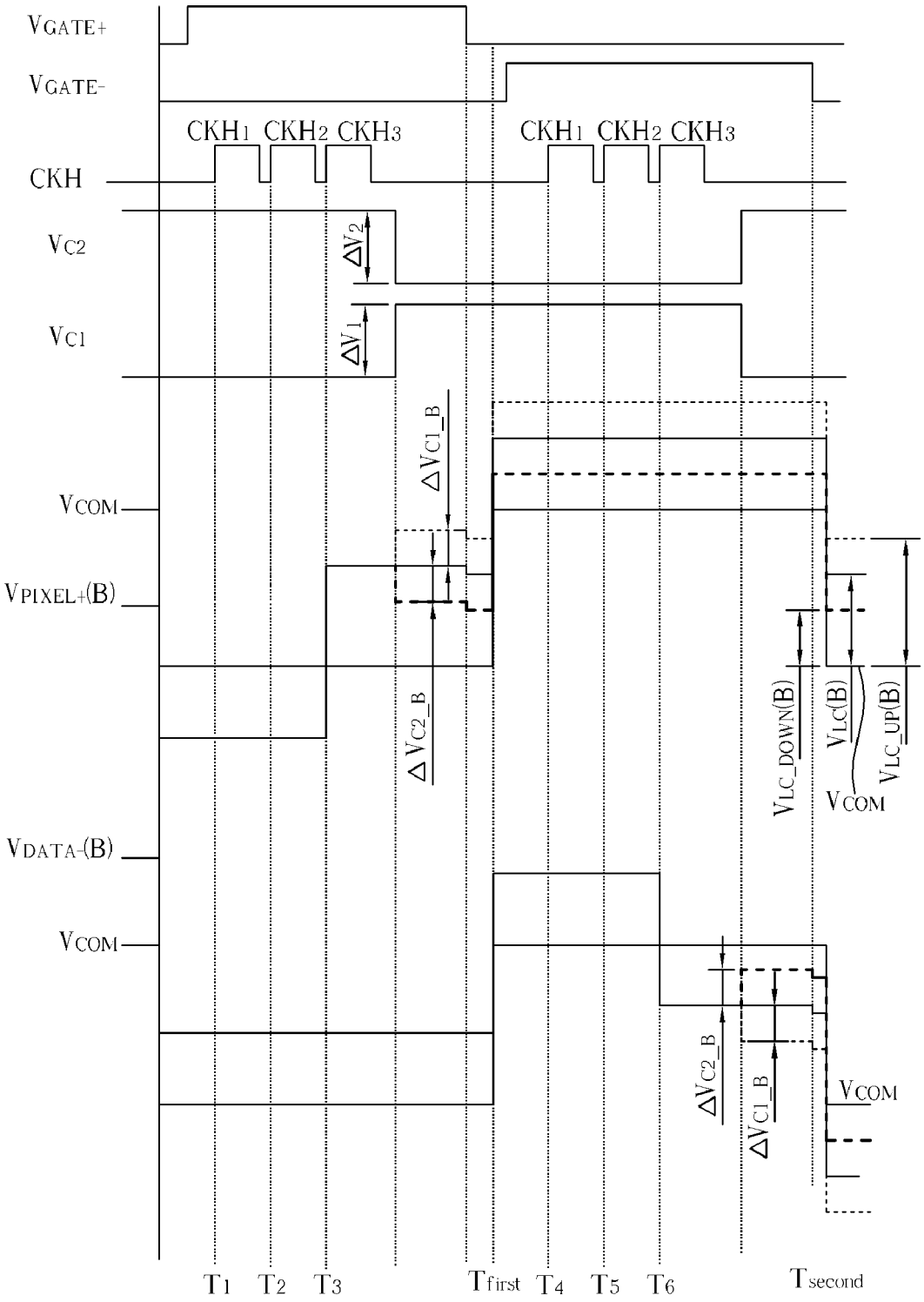
FIGS. 7-9 are timing diagrams illustrating a method for driving the TFT LCD in FIG. 3 according to a second embodiment of the present invention.

In the positive-polarity driving periods illustrated in FIG. 7, the absolute value of the adjusted liquid crystal voltages $V_{LC_UP}(B)$ can be larger than that of the original liquid crystal voltages $V_{LC+}(B)$. Or, the absolute value of the adjusted liquid crystal voltages $V_{LC_DOWN}(B)$ can be smaller than that of the original liquid crystal voltages $V_{LC+}(B)$. In the positive-polarity driving periods illustrated in FIG. 8, the absolute value of the adjusted liquid crystal voltages $V_{LC_UP}(G)$ can be larger than that of the original liquid crystal voltages $V_{LC+}(G)$. Or, the absolute value of the adjusted liquid crystal voltages $V_{LC_DOWN}(G)$ can be smaller than that of the original liquid crystal voltages $V_{LC+}(G)$. In the positive-polarity driving periods illustrated in FIG. 9, the absolute value of the adjusted liquid crystal voltages $V_{LC_UP}(R)$ can be larger than that of the original liquid crystal voltages $V_{LC+}(R)$. Or, the absolute value of the adjusted liquid crystal voltages $V_{LC_DOWN}(R)$ can be smaller than that of the original liquid crystal voltages $V_{LC+}(R)$. As a result, the second embodiment of the present invention can compensate color shifting of the pixel units flexibly when data are written in an R-G-B sequence.

Figure 10:
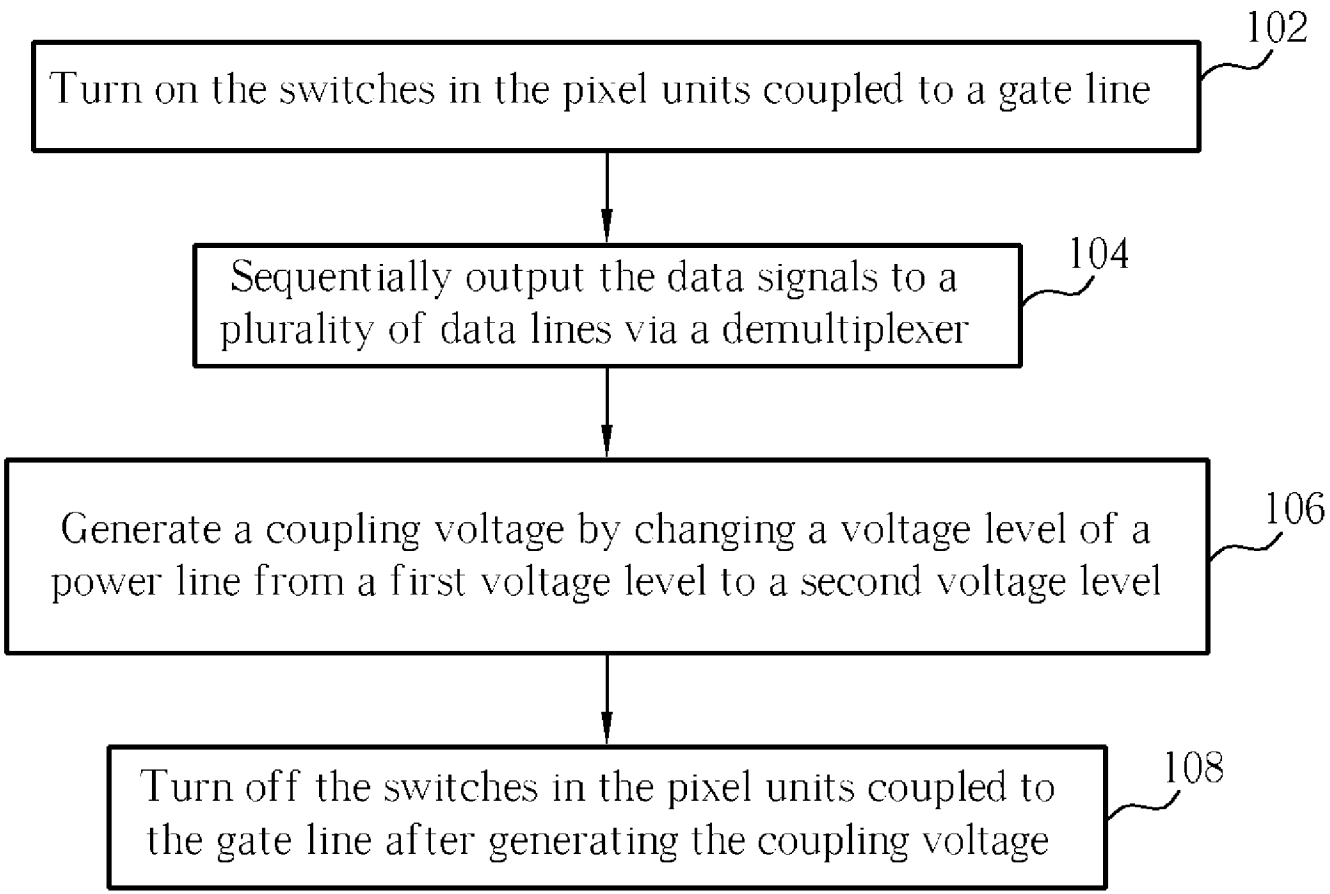
FIG. 10 is a flowchart illustrating operations of the present driving methods when applied to TFT LCDs with demultiplexer structure.

Reference is made to FIG. 10, which depicts a flowchart illustrating operations of the present driving methods when applied to TFT LCDs with a demultiplexer structure. The flowchart in FIG. 10 includes the following steps:

Step 102: turn on the switches in the pixel units coupled to a gate line for receiving data signals from corresponding data lines;

Step 104: sequentially output the data signals to a plurality of data lines via a demultiplexer;

Step 106: generate a coupling voltage by changing a voltage level of a power line from a first voltage level to a second voltage level when the data lines have a floating level after outputting the data signals to a last data line of the demultiplexer, and transmitting the coupling voltage to a data line via a coupling capacitor coupled between the power line and the data line; and Step 108: turn off the switches in the pixel units coupled to the gate line after generating the coupling voltage.

Figure 11:
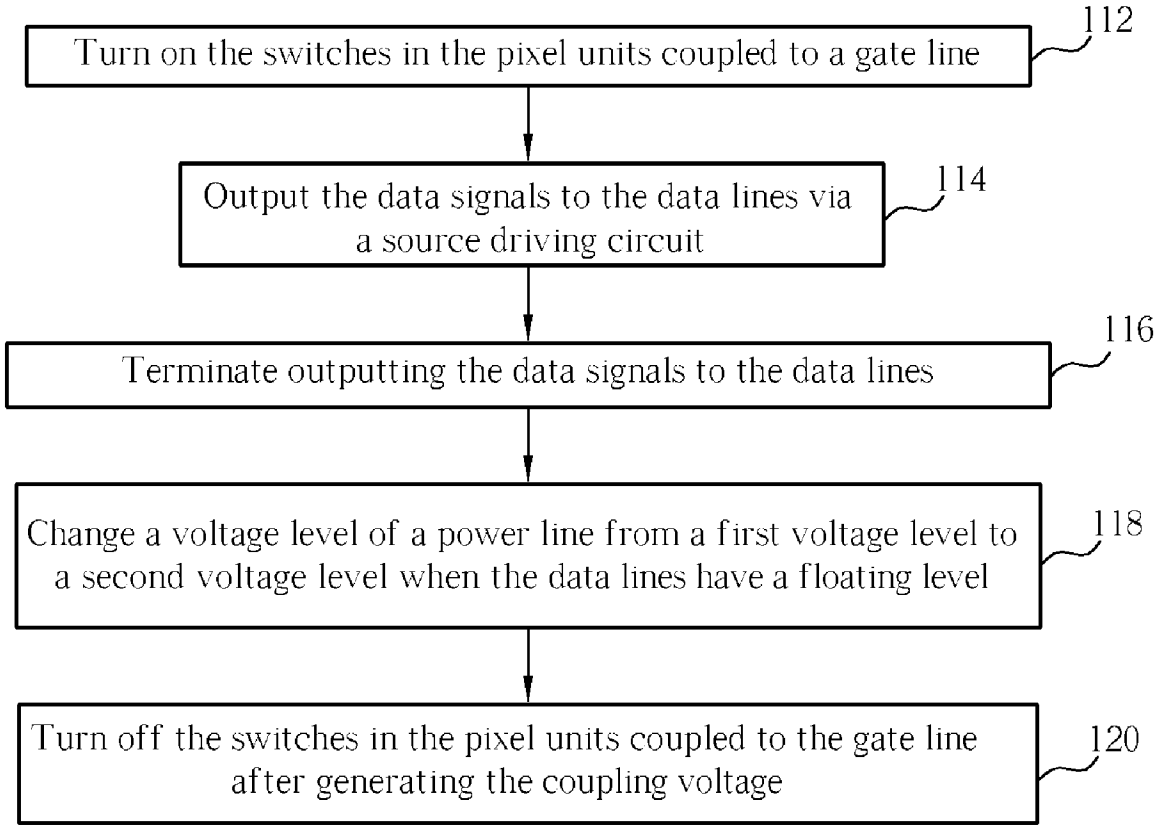
FIG. 11 is a flowchart illustrating operations of the present driving methods when applied to TFT LCDs without demultiplexer structure.

The first and second embodiments of the present invention illustrated in FIGS. 4-9 can be applied to TFT LCDs having a 1-to-3 demultiplexer structure, as well as other structures such as a 1-to-6 or a 1-to-12 demultiplexer structure, etc. The present invention can also be applied to TFT LCDs without a demultiplexer structure. If data are written into the pixel units directly from the source driving circuit on a 1-to-1 basis instead of via a demultiplexer, no control switch is required and therefore no control signal is provided. The data lines need to have floating voltage levels when coupling voltages are generated using the power line. Reference is made to FIG. 11, which depicts a flowchart illustrating operations of the present driving methods when applied to TFT LCDs without a demultiplexer structure. The flowchart in FIG. 11 includes the following steps:

Step 112: turn on the switches in the pixel units coupled to a gate line for receiving data signals from corresponding data lines Step 114: output the data signals to the data lines via a source driving circuit;

Step 116: terminate outputting the data signals to the data lines for keeping the data lines at a floating level;

Step 118: generate a coupling voltage by changing a voltage level of a power line from a first voltage level to a second voltage level when the data lines have a floating level, and transmitting the coupling voltage to a data line via a coupling capacitor coupled between the power line and the data line; and Step 110: turn off the switches in the pixel units coupled to the gate line after generating the coupling voltage.

The present invention provides display devices and driving methods capable of improving display quality. The present invention can be applied to TFT LCDs with/without a demultiplexer structure and implemented with different driving sequences such as dot-, row-, or column-inversion. Different degrees of color shifting can be compensated in a flexible way.

Figure 12:
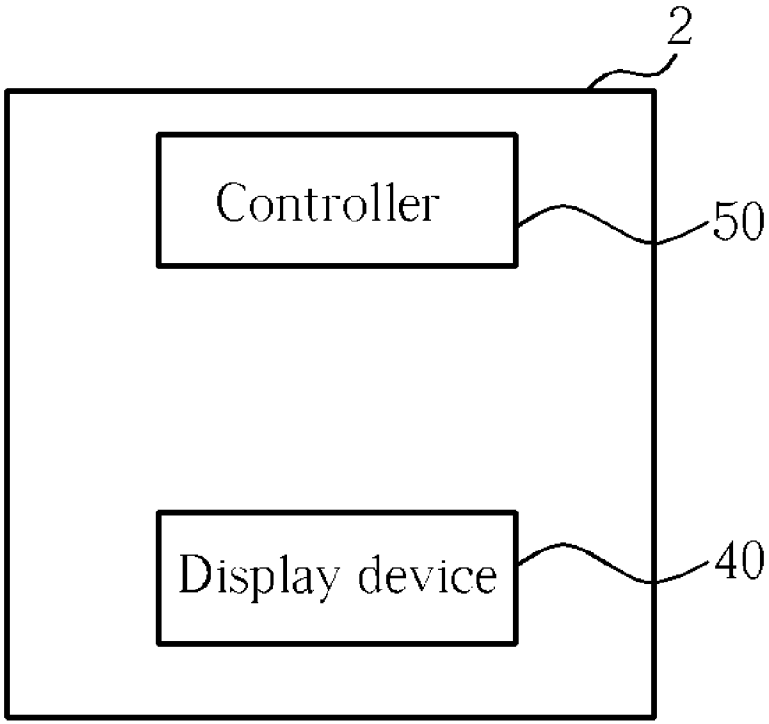
FIG. 12 is a diagram illustrating a display system according to another embodiment of the present invention.

Reference is made to FIG. 12 for a diagram illustrating a display system according to another embodiment of the present invention. In this embodiment, the display system can be a display device 40 or an electronic device 2. As illustrated in FIG. 12, the display device 40 can include the TFT LCD 30 in FIG. 3, or can be integrated into the electronic device 2. Generally, the electronic device 2 can include the display device 40 and a controller 50. The controller 50, electrically connected to the display device 40, can provide an input signal (such as an image signal), based on which the display device 40 can display images. The electronic device 2 can include devices such as mobile phones, digital cameras, PDAs, notebook/desktop computers, televisions, displays for automobiles, or portable DVD players.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display (LCD) system comprising:

an LCD device comprising:

a plurality of gate lines;

a plurality of data lines intersecting the plurality of gate lines;

a plurality of first switches each having a first end coupled to a corresponding gate line and a second end coupled to a corresponding data line;

a plurality of storage units each coupled to a third end of a corresponding first switch for receiving data from the corresponding data line;

a first power line formed in parallel with the plurality of gate lines;

a plurality of first coupling capacitors each having a first end coupled to the first power line and a second end coupled to the corresponding data line;

a source driving circuit coupled to the plurality of data lines for providing data signals; and a plurality of demultiplexers coupled between the source driving circuit and the plurality of corresponding data lines for:

sequentially outputting the data signals to the plurality of data lines after a corresponding first switch coupled to the corresponding gate line and the corresponding data line is turned on;

keeping the plurality of data lines at a floating level after outputting the data signals;

generating a coupling voltage by changing a voltage level of the first power line from a first voltage level to a second voltage level; and sequentially transmitting the coupling voltage to the data lines via the plurality of first coupling capacitors.

2. The LCD system of claim 1 further comprising:

a second power line formed in parallel with the plurality of gate lines; and a plurality of second coupling capacitors each having a first end coupled to the second power line and a second end coupled to the corresponding data line.

3. The LCD system of claim 1 further comprising a control circuit coupled to the first and second power lines for controlling voltage levels of the first and second power lines.

4. The LCD system of claim 1 further comprising:

a gate driving circuit coupled to the plurality of gate lines for transmitting control signals to the plurality of first switches via the corresponding gate lines.

5. The LCD system of claim 1 wherein each demultiplexer includes a plurality of second switches coupled to the source driving circuit and the data lines for controlling signal transmission paths through which the data signals are transmitted from the source driving circuit to the data lines.

6. The LCD system of claim 5 wherein the second switches include thin film transistors (TFTs).

7. The LCD system of claim 1 wherein the first switches include TFTs.

8. The LCD system of claim 1 further comprising an electronic device including:

the LCD device; and a controller coupled to the LCD device for providing an input signal based on which the LCD device displays images.

9. A method for driving an LCD system comprising:

turning on a first switch in a pixel unit coupled to a gate line for receiving a data signal from a corresponding data line;

sequentially outputting data signals to a plurality of data lines via a demultiplexer;

turning off the demultiplexer for keeping the plurality of data lines at a floating level;

generating a coupling voltage by changing a voltage level of a power line from a first voltage level to a second voltage level, and transmitting the coupling voltage to a first data line of the demultiplexer via a coupling capacitor coupled between the power line and the first data line; and turning off the first switch in the pixel unit coupled to the gate line after generating the coupling voltage.

10. The method of claim 9 wherein sequentially outputting the data signals to the plurality of data lines via the demultiplexer is a source driving circuit sequentially outputting the data signals to the plurality of data lines via the demultiplexer.

11. The method of claim 9 further comprising:

generating a coupling voltage by changing the voltage level of the power line from the second voltage level to the first voltage level, and transmitting the coupling voltage to a second data line of the demultiplexer via a coupling capacitor coupled between the power line and the second data line.

12. The method of claim 9 wherein changing the voltage level of the power line from the first voltage level to the second voltage level is changing the voltage level of the power line from a high voltage level to a low voltage level.

13. The method of claim 9 wherein changing the voltage level of the power line from the first voltage level to the second voltage level is changing the voltage level of the power line from a low voltage level to a high voltage level.

14. A method for driving an LCD system comprising:

turning on a switch in a pixel unit coupled to a gate line for receiving a data signal from a corresponding data line;

outputting data signals to a plurality of data lines using a source driving circuit;

terminating outputting the data signals to the plurality of data lines for keeping the plurality of data lines at a floating level;

generating a coupling voltage by changing a voltage level of a power line from a first voltage level to a second voltage level, and transmitting the coupling voltage to a first data line via a coupling capacitor coupled between the power line and the first data line after keeping the plurality of data lines at the floating level; and turning off the switch in the pixel unit coupled to the gate line after generating the coupling voltage.

15. The method of claim 14 further comprising:

generating a coupling voltage by changing the voltage level of the power line from the second voltage level to the first voltage level, and transmitting the coupling voltage to a second data line via a coupling capacitor coupled between the power line and the second data line.

16. The method of claim 14 wherein changing the voltage level of the power line from the first voltage level to the second voltage level is changing the voltage level of the power line from a high voltage level to a low voltage level.

17. The method of claim 14 wherein changing the voltage level of the power line from the first voltage level to the second voltage level is changing the voltage level of the power line from a low voltage level to a high voltage level.

* * * * *